US008736411B2

(12) United States Patent
Yen

(10) Patent No.: US 8,736,411 B2
(45) Date of Patent: May 27, 2014

(54) TRANSFORMER STRUCTURE

(75) Inventor: Chun-Ching Yen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/282,625

(22) Filed: Oct. 27, 2011

(65) Prior Publication Data

US 2012/0161913 A1 Jun. 28, 2012

(30) Foreign Application Priority Data

Dec. 22, 2010 (TW) ..... 99145384 A

(51) Int. Cl.
*H01F 27/02* (2006.01)
*H01F 27/30* (2006.01)
*H01F 27/24* (2006.01)

(52) U.S. Cl.
USPC ..... 336/59; 336/198; 336/208; 336/212

(58) Field of Classification Search
USPC ..... 336/192, 198, 208, 212, 182, 59, 90
See application file for complete search history.

(56) References Cited

U.S. PATENT DOCUMENTS 7,446,637 B1 * 11/2008 Liang et al. ..... 336/65
7,449,986 B2 * 11/2008 Yamaguchi et al. ..... 336/192
7,724,115 B2 * 5/2010 Chen et al. ..... 336/198
7,760,063 B2 * 7/2010 Lin et al. ..... 336/208
8,054,152 B2 * 11/2011 Tseng et al. ..... 336/192
8,179,222 B2 * 5/2012 Lee et al. ..... 336/208
2008/0024262 A1 * 1/2008 Chang et al. ..... 336/208
2008/0100407 A1 * 5/2008 Yamaguchi et al. ..... 336/192
2010/0237972 A1 * 9/2010 Yen et al. ..... 336/65
2011/0115593 A1 * 5/2011 Liao et al. ..... 336/90

FOREIGN PATENT DOCUMENTS

CN 101447324 6/2009

* cited by examiner

*Primary Examiner* — Alexander Talpalatski
*Assistant Examiner* — Mangtin Lian
(74) *Attorney, Agent, or Firm* — Kirton McConkie; Evan R. Witt

(57) ABSTRACT

A transformer includes a winding member, a magnetic core assembly and an insulating seat. The winding member includes a bobbin, a primary coil and a secondary coil. The primary coil and the secondary coil are wound on the bobbin. The magnetic core assembly includes a first magnetic core and a second magnetic core. The winding member is arranged between the first magnetic core and the second magnetic core. The insulating seat includes a receptacle, at least one ventilation hole, at least one sheltering member and plural pins. The winding member and the magnetic core assembly are accommodated within the receptacle. The ventilation hole is formed in the sheltering member. The first terminals of the primary coil and/or the second terminals of the secondary coil are connected with the pins.

7 Claims, 6 Drawing Sheets

TRANSFORMER STRUCTURE

FIELD OF THE INVENTION

The present invention relates to a transformer, and more particularly to a transformer with a ventilation hole.

BACKGROUND OF THE INVENTION

Recently, a transformer has become an essential magnetic element for regulating voltage into required voltages for various kinds of electric appliances.

FIG. 1 is a schematic perspective view illustrating a conventional transformer. As shown in FIG. 1, the transformer 1 comprises a bobbin 10, a primary coil (not shown), a secondary coil (not shown) and a magnetic core assembly 11. The primary coil and the secondary coil are separately wound on the bobbin 10. In addition, an insulating tape 12 is wound on the primary coil and the secondary coil. The terminals 131 of the primary coil are wound and fixed on corresponding pins 101 of the bobbin 10. In addition, the first terminals 131 of the primary coil are sheathed by corresponding tubes 132. The terminals 141 of the secondary coil are sheathed by corresponding tubes 142 and used as fly wires. The magnetic core assembly 11 is partially accommodated within a channel (not shown) of the bobbin 10. Plural layers of insulating tapes 12 are wound on the magnetic core assembly 11 in order to comply with the safety requirements. The transformer 1 can be electrically connected with a circuit board through the pins 101 and the terminals 141 of the secondary coil.

The conventional transformer 1, however, still has some drawbacks. For example, during operation of the transformer 1, the temperatures of the primary coil, the secondary coil and the magnetic core assembly 11 will be largely increased. Since the insulating tapes 12 are wound on the magnetic core assembly 11, the heat generated by the transformer 1 is difficult to be dissipated away. If a large amount of heat is accumulated within the transformer 1, the operating performance and electrical safety of the power circuit having the transformer 1 will be deteriorated.

SUMMARY OF THE INVENTION

The present invention provides a transformer having good heat dissipation and safety distance between the terminals of the coils and between the magnetic core assembly and the terminals of the coils.

In accordance with an aspect of the present invention, there is provided a transformer. The transformer includes a winding member, a magnetic core assembly and an insulating seat. The winding member includes a bobbin, a primary coil and a secondary coil. The primary coil and the secondary coil are wound on the bobbin. The magnetic core assembly includes a first magnetic core and a second magnetic core. The winding member is arranged between the first magnetic core and the second magnetic core. The insulating seat includes a receptacle, at least one ventilation hole, at least one sheltering member and plural pins. The winding member and the magnetic core assembly are accommodated within the receptacle. The ventilation hole is formed in the sheltering member. The first terminals of the primary coil and/or the second terminals of the secondary coil are connected with the pins.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
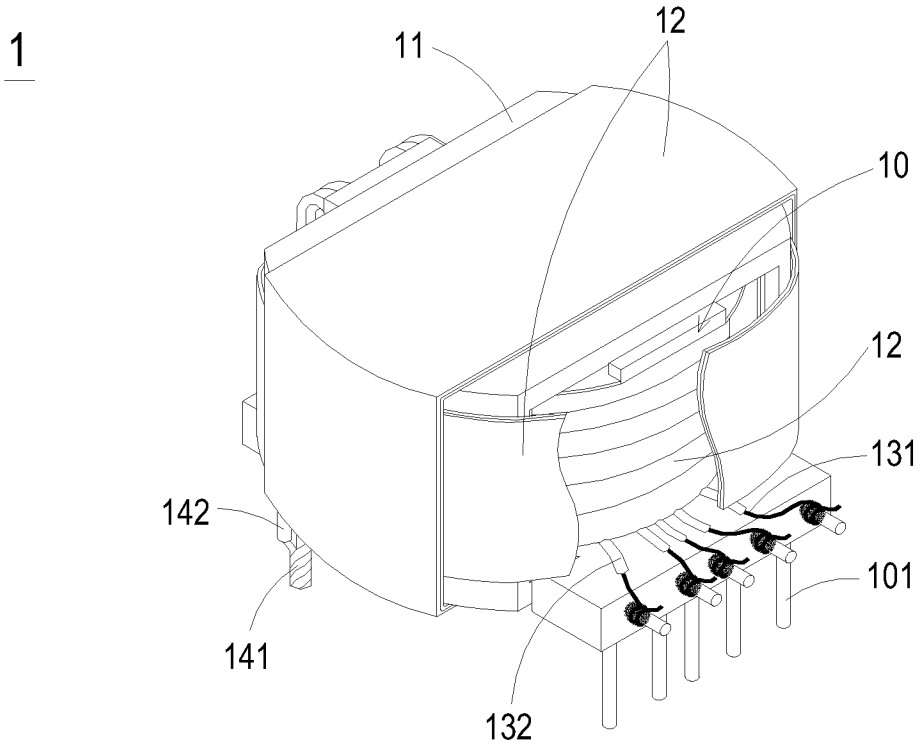
FIG. 1 PRIOR ART
FIG. 1 is a schematic perspective view illustrating a conventional transformer.
Figure 2:
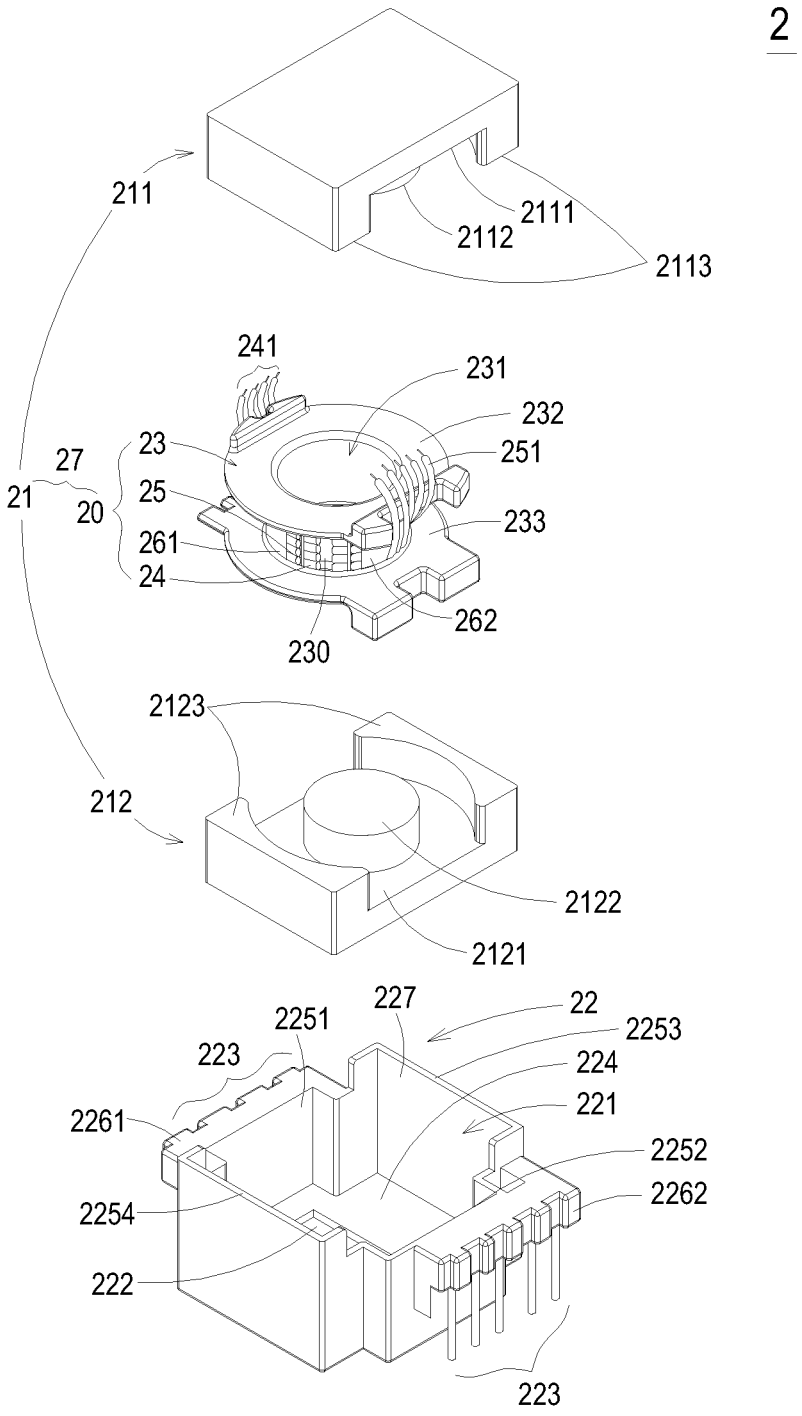
FIG. 2 is a schematic exploded view illustrating a transformer according to an embodiment of the present invention.

FIG. 2 is a schematic exploded view illustrating a transformer according to an embodiment of the present invention. As shown in FIG. 2, the transformer 2 comprises a winding member 20, a magnetic core assembly 21 and an insulating seat 22. The winding member 20 comprises a bobbin 23, a primary coil 24 and a secondary coil 25. The primary coil 24 and the secondary coil 25 are insulated from each other and respectively wound on the bobbin 23. The magnetic core assembly 21 comprises a first magnetic core 211 and a second magnetic core 212. The winding member 20 is arranged between the first magnetic core 211 and the second magnetic core 212. The insulating seat 22 comprises a receptacle 221, at least one ventilation hole 222, at least one sheltering member and plural pins 223. The receptacle 221 is used for accommodating the winding member 20 and the magnetic core assembly 21.

The pins 223 are disposed on a first extension plate 2261 and a second extension plate 2262. The first extension plate 2261 and the second extension plate 2262 are respectively extended from a first sidewall 2251 and a second sidewall 2252 (see FIG. 3) of the insulating seat 22. That is, the first extension plate 2261 and the second extension plate 2262 are arranged on opposite sides of the insulating seat 22. In addition, the first terminals 241 of the primary coil 24 and the second terminals 251 of the secondary coil 25 are connected with the pins 223 on the first extension plate 2261 and the pins 223 on the second extension plate 2262, respectively.

Please refer to FIG. 2 again. The bobbin 23 comprises a winding section 230, a channel 231, a first lateral plate 232 and a second lateral plate 233. The winding section 230 is arranged between the first lateral plate 232 and the second lateral plate 233. The primary coil 24 and the secondary coil 25 are wound on the winding section 230. The channel 231 runs through the first lateral plate 232, the winding section 230 and the second lateral plate 233 for partially accommodating the magnetic core assembly 21. It is preferred that the components of the bobbin 23 are integrally formed. In addition, the primary coil 24 and the secondary coil 25 are conductive wires sheathed by insulating substances. After the primary coil 24 and the secondary coil 25 are wound on the winding section 230 of the bobbin 23, the primary coil 24 and the secondary coil 25 can be isolated from each other through a first insulating medium 261 (e.g. an insulating tape). Furthermore, a second insulating medium 262 is optionally wound around the outer periphery of the secondary coil 25 in order to enhance the isolating efficacy. In addition, the first terminals 241 of the primary coil 24 and the second terminals 251 of the secondary coil 25 are protruded out of the winding section 230 of the bobbin 23 in the opposite directions.

In this embodiment, the first magnetic core 211 and the second magnetic core 212 of the magnetic core assembly 21 collectively define an EE-shaped magnetic core assembly. The first magnetic core 211 comprises a connecting part 2111, a middle post 2112 and two lateral posts 2113. The second magnetic core 212 comprises a connecting part 2121, a middle post 2122 and two lateral posts 2123. The two lateral posts 2113 are vertically extended from two opposite edges of the connecting part 2111, respectively. The middle post 2112 is vertically extended from a center portion of the connecting part 2111 and arranged between the two lateral posts 2113. The two lateral posts 2123 are vertically extended from two opposite edges of the connecting part 2121, respectively. The middle post 2122 is vertically extended from a center portion of the connecting part 2121 and arranged between the two lateral posts 2123. For combining the magnetic core assembly 21 with the winding member 20, the middle post 2112 of the first magnetic core 211 and the middle post 2122 of the second magnetic core 212 are partially accommodated within the channel 231 of the bobbin 23. At the same time, the connecting part 2111 of the first magnetic core 211 and the connecting part 2121 of the second magnetic core 212 are respectively attached on the first lateral plate 232 and the second lateral plate 233; and the winding member 20 is partially enclosed by the two lateral posts 2113 of the first magnetic core 211 and the two lateral posts 2123 of the second magnetic core 212. In some embodiments, the first magnetic core 211 and the second magnetic core 212 are connected with each other via adhesive (not shown) so that the winding member 20 is securely fixed between the first magnetic core 211 and the second magnetic core 212. In such way, the combination structure 27 of the magnetic core assembly 21 and the winding member 20 is assembled.

Figure 3:
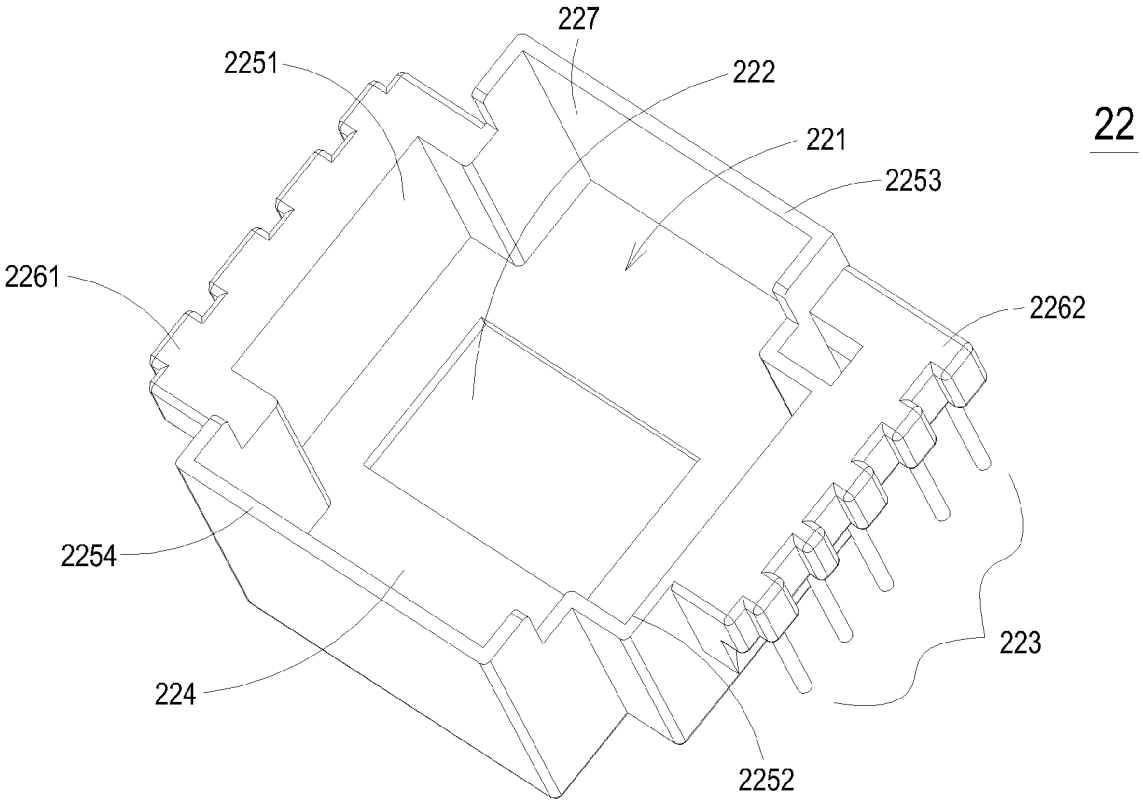
FIG. 3 is a schematic perspective view illustrating an insulating seat used in the transformer of FIG. 2.

FIG. 3 is a schematic perspective view illustrating an insulating seat used in the transformer of FIG. 2. Please refer to FIGS. 2 and 3. The insulating seat 22 comprises at least one sheltering member, which includes a first sidewall 2251, a second sidewall 2252, a third sidewall 2253, a fourth sidewall 2254 and a bottom plate 224. The first sidewall 2251 and the second sidewall 2252 are opposed to each other. The third sidewall 2253 and the fourth sidewall 2254 are opposed to each other. In such way, the first sidewall 2251, the second sidewall 2252, the third sidewall 2253, the fourth sidewall 2254 and the bottom plate 224 collectively define a receptacle 221 and an entrance 227. In this embodiment, the ventilation hole 222 is formed in the bottom plate 224, and opposed to the entrance 227. In addition, the insulating seat 22 further comprises a first extension plate 2261 and a second extension plate 2262. The first extension plate 2261 and the second extension plate 2262 are externally extended from the first sidewall 2251 and the second sidewall 2252, respectively. The pins 223 are partially embedded into the first extension plate 2261 and the second extension plate 2262. In addition, the pins 223 are extended from the first extension plate 2261 and the second extension plate 2262 in the direction parallel with the first sidewall 2251 and the second sidewall 2252. As shown in FIGS. 2 and 3, the first terminals 241 of the primary coil 24 are closer to the ventilation hole 222 than the second terminals 251 of the secondary coil 25. The ventilation hole 222 can have a rectangular shape, a circular shape or any arbitrary shape. In addition, the location and the shape of the ventilation hole 222 can be varied according to the practical requirements.

Figure 4A:
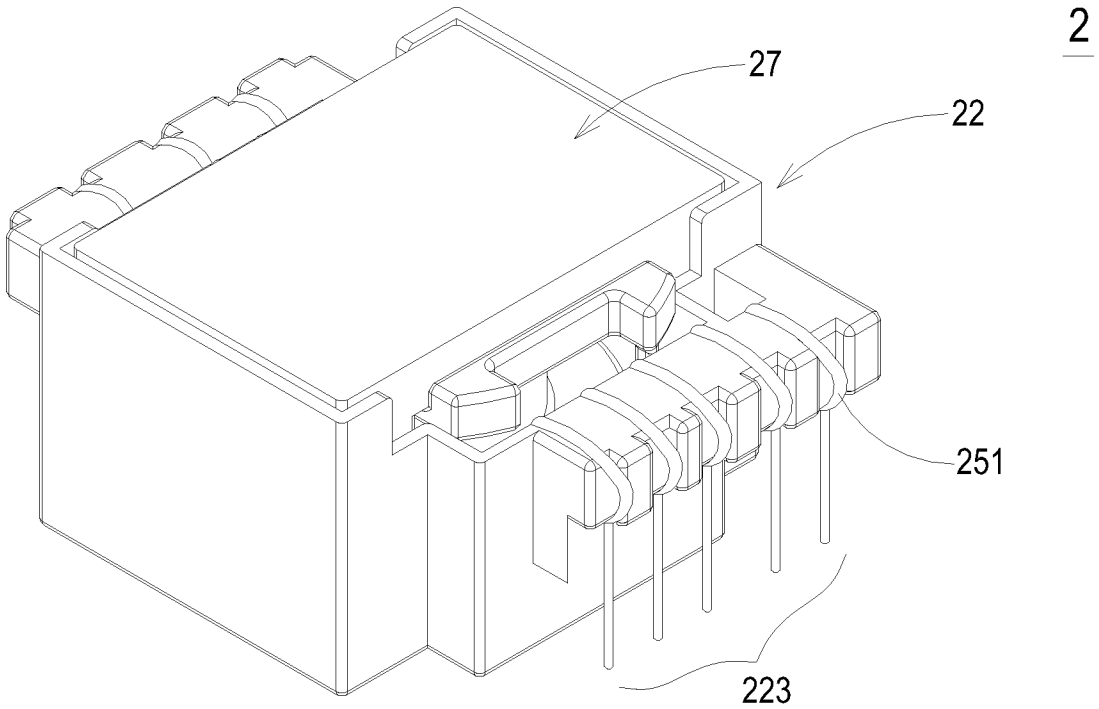
FIGS. 4A and 4B are schematic perspective views illustrating the assembled structure of the transformer of FIG. 2 and taken along different viewpoints.
Figure 4B:
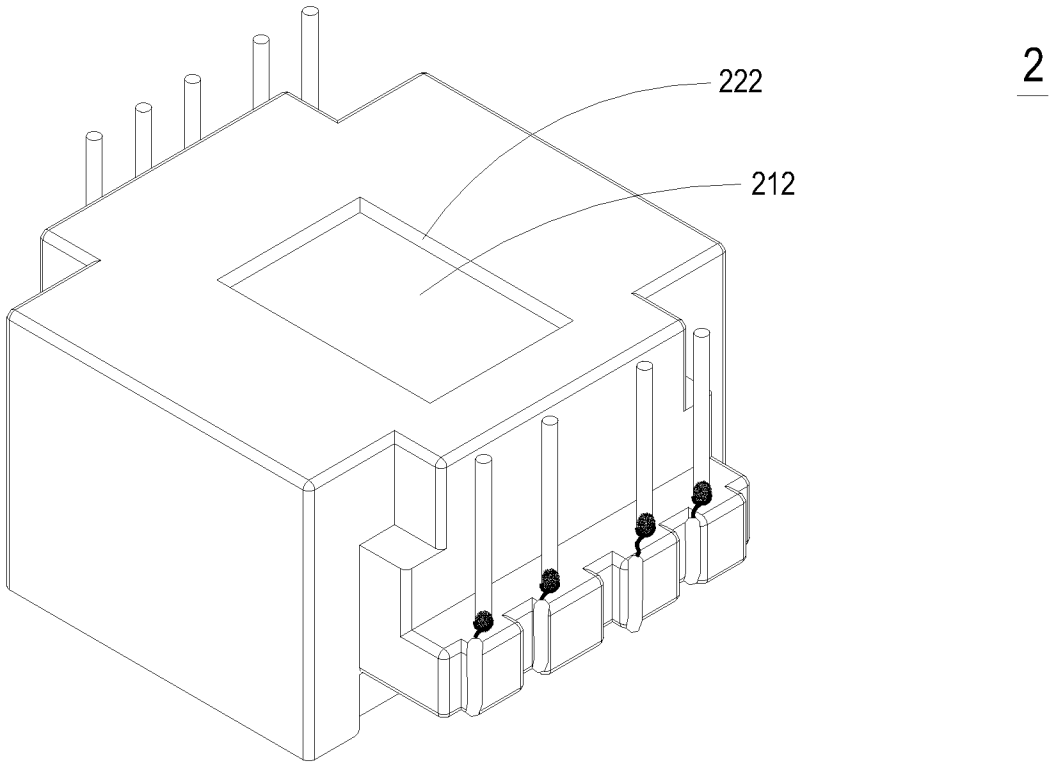

FIGS. 4A and 4B are schematic perspective views illustrating the assembled structure of the transformer of FIG. 2 and taken along different viewpoints. As shown in FIG. 4A, the combination structure 27 of the magnetic core assembly 21 and the winding member 20 is accommodated within the receptacle 221 of the insulating seat 22, wherein the second magnetic core 212 is attached on the bottom plate 224 of the insulating seat 22. In such way, the transformer 2 is assembled. As shown in FIG. 4B, the second magnetic core 212 is attached on the bottom plate 224 of the insulating seat 22. Through the ventilation hole 222, the second magnetic core 212 is exposed to the surroundings. During operation of the transformer 2, the heat generated from the second magnetic core 212 and the bottom plate 224 of the insulating seat 22 can be dissipated to the surroundings through the ventilation hole 222. Consequently, the operating temperature of the transformer 2 is reduced, and the heat-dissipating efficacy is enhanced. In addition, the safety distance between the terminals of the coils and the safety distance between the magnetic core assembly and the terminals of the coils are also increased. In this embodiment, the insulating seat 22 is produced by a plastic injection molding process. Due to the ventilation hole 222, the material of fabricating the insulating seat 22 is saved. Consequently, the transformer 2 of the present invention is cost-effective.

Figure 5:
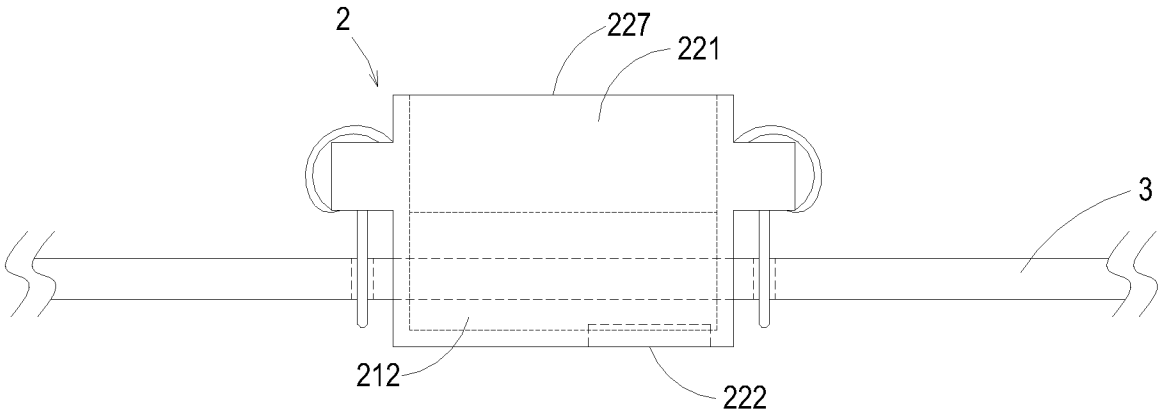
FIG. 5 is a schematic view illustrating the transformer of FIG. 4A installed on a circuit board.

FIG. 5 is a schematic view illustrating the transformer of FIG. 4A installed on a circuit board. The transformer 2 is disposed and installed on the circuit board 3, wherein the bottom plate 224 of the insulating seat 22 is parallel to the circuit board 3 and perpendicular to an extension direction of the pins 223. The heat generated from the second magnetic core 212 can be dissipated away to the surroundings through the ventilation hole 222, and the heat generated from the first magnetic core 211 can be dissipated away to the surroundings through the entrance 227 of the insulating seat 22. As a consequence, the heat-dissipating efficacy is enhanced, and the operating temperature of the transformer 2 is reduced.

From the above description, the transformer of the present invention has a ventilation hole in the bottom plate of the insulating seat. Through the ventilation hole, the second magnetic core is exposed to the surroundings. During operation of the transformer, the heat generated from the second magnetic core and the bottom plate of the insulating seat can be dissipated to the surroundings through the ventilation hole. Consequently, the operating temperature of the transformer is reduced. Moreover, since the insulating seat is produced by a plastic injection molding process, the material of fabricating the insulating seat is saved because of the ventilation hole.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer disposed on a circuit board, comprising:

a winding member comprising a bobbin, a primary coil and a secondary coil, wherein said primary coil and said secondary coil are wound on said bobbin;

a magnetic core assembly comprising a first magnetic core and a second magnetic core, wherein said winding member is arranged between said first magnetic core and said second magnetic core; and an insulating seat comprising a receptacle, at least one ventilation hole, an entrance, at least one sheltering member and plural pins, wherein said winding member and said magnetic core assembly are accommodated within said receptacle, said sheltering member comprises a bottom plate parallel to said circuit board and perpendicular to an extension direction of said pins, said second magnetic core is attached on said bottom plate of said sheltering member, said ventilation hole is formed in said bottom plate of said sheltering member so that said second magnetic core is supported by said bottom plate and exposed to surroundings through said ventilation hole, said entrance is opposed to said ventilation hole so that said first magnetic core is exposed to surroundings through said entrance, and at least a first terminal of said primary coil and/or at least a second terminal of said secondary coil are connected with said pins.

2. The transformer according to claim 1, wherein said bobbin comprises a winding section, a channel, a first lateral plate and a second lateral plate, wherein said winding section is arranged between said first lateral plate and said second lateral plate for winding said primary coil and said secondary coil, wherein said channel runs through said first lateral plate, said winding section and said second lateral plate for partially accommodating said magnetic core assembly.

3. The transformer according to claim 2, wherein each of said first magnetic core and said second magnetic core comprises a connecting part, a middle post and two lateral posts, wherein said two lateral posts are vertically extended from two opposite edges of said connecting part, respectively, wherein said middle post is vertically extended from a center portion of said connecting part, and arranged between said two lateral posts.

4. The transformer according to claim 3, wherein said middle posts of said first magnetic core and said second magnetic core are partially accommodated within said channel of said bobbin, said connecting parts of said first magnetic core and said second magnetic core are respectively attached on said first lateral plate and said second lateral plate of said bobbin, and said winding member is partially enclosed by said two lateral posts of said first magnetic core and said two lateral posts of said second magnetic core.

5. The transformer according to claim 1, wherein said at least one sheltering member of said insulating seat comprises a first sidewall, a second sidewall, a third sidewall, a fourth sidewall and said bottom plate, wherein said first sidewall and said second sidewall are opposed to each other, and said third sidewall and said fourth sidewall are opposed to each other, wherein said first sidewall, said second sidewall, said third sidewall, said fourth sidewall and said bottom plate define said receptacle and said entrance.

6. The transformer according to claim 5, wherein said insulating seat further comprises a first extension plate and a second extension plate, which are externally extended from said first sidewall and said second sidewall, respectively, wherein said pins are partially embedded into said first extension plate and said second extension plate.

7. The transformer according to claim 1, wherein said first terminals of said primary coil are closer to said ventilation hole than said second terminals of said secondary coil.

* * * * *